United States Patent [19]

Drew, III

[11] Patent Number: 4,919,480

[45] Date of Patent: Apr. 24, 1990

[54] SECTIONAL BENCH

[76] Inventor: James H. Drew, III, P.O. Box 5536, Augusta, Ga. 30916

[21] Appl. No.: 410,754

[22] Filed: Sep. 22, 1989

[51] Int. Cl.[5] ..... A47C 11/00

[52] U.S. Cl. ..... 297/244; 297/157; 297/440

[58] Field of Search ..... 297/157, 159, 232, 244, 297/440, 443; 182/181, 185

[56] References Cited

U.S. PATENT DOCUMENTS

| | | | |
|---|---|---|---|
| 769,354 | 9/1904 | Nielsen . | |
| 835,059 | 11/1906 | Curley . | |
| 1,542,770 | 6/1925 | Hess . | |
| 1,659,840 | 2/1928 | Smith | 297/159 X |
| 2,244,963 | 12/1939 | Poll . | |
| 2,271,496 | 4/1940 | Hofman . | |
| 2,558,465 | 6/1951 | Seymour | 297/159 X |
| 2,642,925 | 9/1950 | Seymour . | |
| 2,800,952 | 11/1954 | McPhilomy . | |
| 3,047,337 | 3/1961 | Carver . | |
| 3,256,037 | 6/1966 | Giambalvo | 297/159 |
| 3,544,052 | 12/1970 | Conklin | 182/181 X |
| 4,747,469 | 5/1988 | Phillips | 182/185 |

*Primary Examiner*—Peter R. Brown
*Attorney, Agent, or Firm*—Lorusso & Loud

[57] ABSTRACT

In the disclosed embodiments the bench of the invention has six components or sections. Two sections are A-shaped support members, i.e. leg sections, each having a horizontal brace. A third section is a seat section which provides two parallel bench seats separated by a space which receives the two A-shaped support sections. More specifically, the A-shaped sections are received into the space between parallel rails, two sets of which support the bench seats. At least one rail at each end of the bench seats rests on a horizontal brace of an A-shaped support. The abutting rail and horizontal brace pair are locked together by insertion between blocks fixed to a stud with the spacing of the blocks providing a snug fit for the abutting rail and horizontal brace. The end of the stud opposite the blocks extends vertically to approximately the apex of the A-shaped support members. The apex of each A-shaped support member and the upper end of each of the locking studs fit into brackets in a top piece or cap which carries a back support for each seat.

18 Claims, 3 Drawing Sheets

FIG. 1
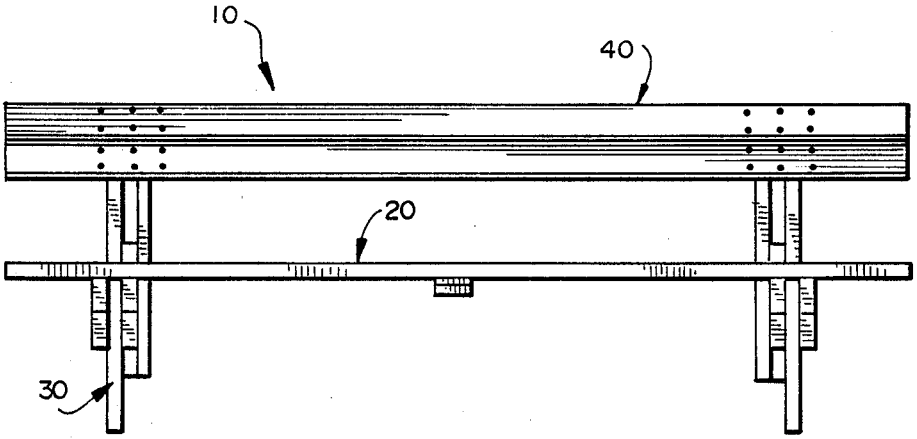
FIG. 2
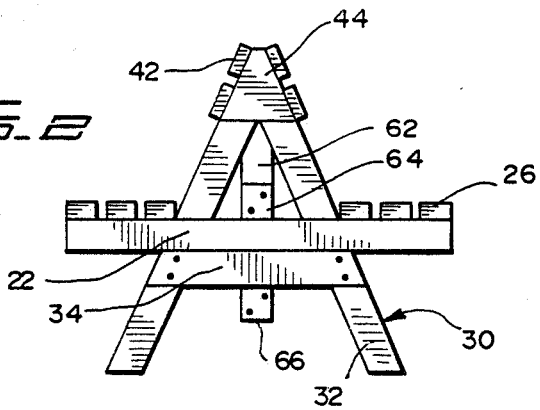
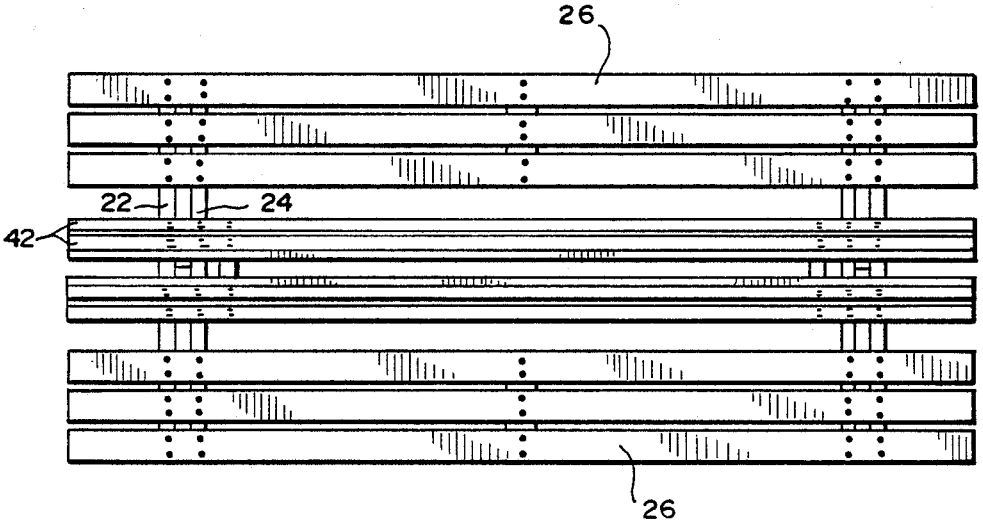
FIG. 3

FIG. 4A
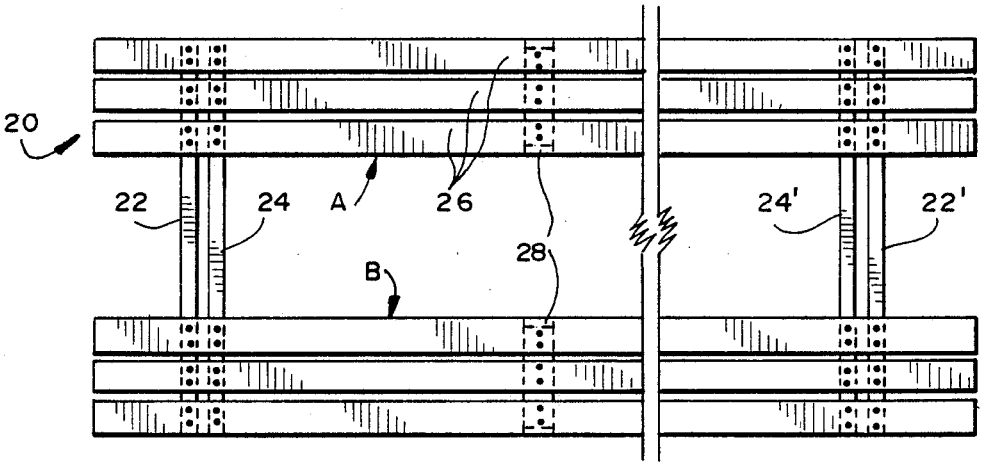
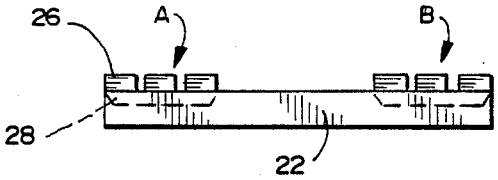
FIG. 4B
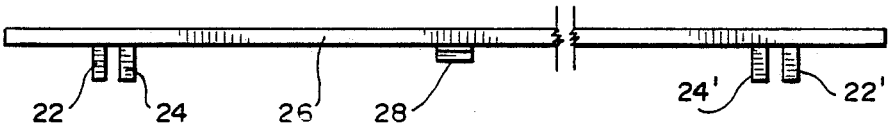
FIG. 4C
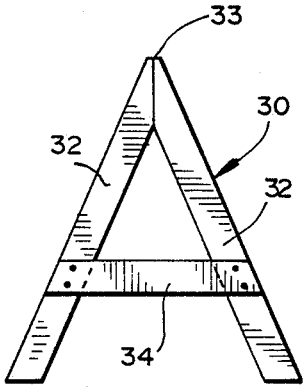
FIG. 5A
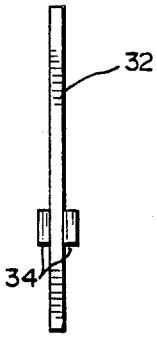
FIG. 5B
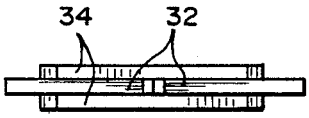
FIG. 5C FIG. 6A
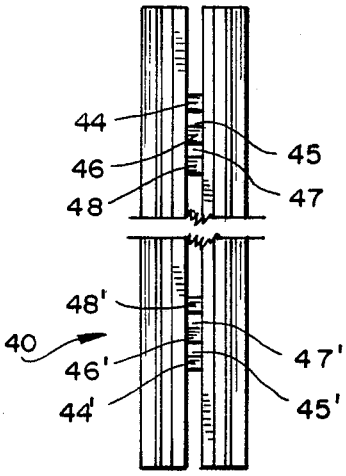
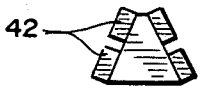
FIG. 6B
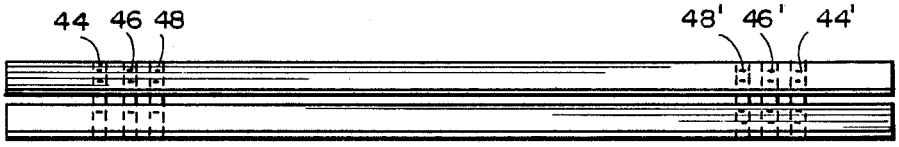
FIG. 6C
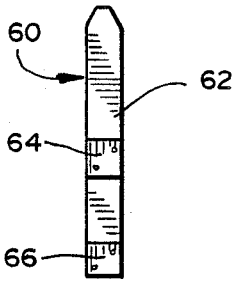
FIG. 7A
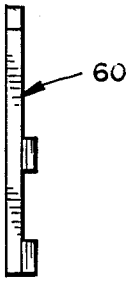
FIG. 7B

SECTIONAL BENCH

BACKGROUND OF THE INVENTION

Many businesses, religious groups and other organizations have need for seating which can be quickly assembled and disassembled and which stores in a minimum of space. Ideally, such seating should be capable of assembly from a minimum of component parts without use of small fastening elements, e.g. screws, bolts, etc., which tend to become lost. The present inventor has been engaged in the business of providing rides for circuses and fairs and has found it advantageous to his business to provide seating for adults at the site of kiddie rides which he operates. However, he has encountered a problem in obtaining suitable seating for adults compatible with such sites and lending itself to quick assembly and disassembly from components that, when broken down, occupy a minimum of space in transport between fairs.

SUMMARY OF THE INVENTION

Accordingly, it is an object of the present invention to provide a bench capable of supporting the weight of a number of adults, which bench can be assembled quickly from a minimum number of components.

It is another object of the present invention to provide such a bench which ca be assembled without conventional fasteners such as screws, nuts and bolts and nails.

The present inventor has discovered that a bench meeting the above criteria can be provided, in the form of one preferred embodiment, in six components or sections. Two sections are A-shaped support members, i.e. leg sections, each having a horizontal brace. A third section is a seat section which provides two parallel bench seats separated by a space which receives the two A-shaped support sections. More specifically, the A-shaped sections are received into the space between parallel rails, two sets of which support the bench seats. At least one rail at each end of the bench seats rests on a horizontal brace of an A-shaped support. The abutting rail and horizontal brace pair are locked together by insertion between blocks fixed to a stud with the spacing of the blocks providing a snug fit for the abutting rail and horizontal brace. The end of the stud opposite the blocks extends vertically to approximately the apex of the A-shaped support members. The apex of each A-shaped support member and the upper end of each of the locking studs fit into brackets in a top piece or cap which carries a back support for each seat.

BRIEF DESCRIPTION OF THE DRAWINGS

In the drawings:

FIG. 1 is a side elevational view of one embodiment of the present invention in fully assembled state;

FIG. 2 is a end view of the assembled embodiment of FIG. 1;

FIG. 3 is plan view of the assembled embodiment of FIG. 1;

FIG. 4A is a plan view of the seat section of the embodiment of FIGS. 1–3;

FIG. 4B is an end view of the seat section of FIG. 4A;

FIG. 4C is a side elevation of the seat section of FIG. 4A;

FIG. 5A is an elevational view of an A-shaped support section, two of which form the assembled embodiment of FIGS. 1–3;

FIG. 5B is side elevation of the A-shaped section of FIG.

FIG. 5C is a plan view of the A-shaped section of FIG. 5A;

FIG. 6 is a plan view of the top or cap section of the bench of FIGS. 1–3;

FIG. 6B is an end view of the top section of FIG. 6A;

FIG. 6C is a side elevation of the top section of FIG. 6A;

FIG. 7A is a side elevation of a locking member, two of which are included in the bench of FIGS. 1–3; and FIG. 7B is a side elevation of the locking member of FIG. 7A turned 90°.

DESCRIPTION OF THE PREFERRED EMBODIMENT

As seen in the drawing figures, the bench 10 which they illustrate has 6 sections including a seat section 20, two A-shaped sections 30, a top or cap section 40 and two locking members 60. All six sections are unitary components with the parts of each section securely fastened together with wood screws, nails, etc. In the illustrated embodiment all sections are formed of wood 2×4's (actual dimensions 3½"×1½"); however, wooden 2×6's, plastic, etc. may also be used to fabricate the various sections. As will be described in more detail below, the six sections may be assembled without fasteners to form a seating bench capable of supporting the weight of four or more adults. The terminology "fastening elements" and "conventional fasteners" as used herein has reference to glue, screws, nuts and bolts, nails, rivets, clamps, etc.

As seen in FIGS. 4A, 4B and 4C, seat section 20 provides elongated seats A and B, each formed of three elongated seat members 26 (2×4's) secured, e.g. by wood screws, to the upper edge of each rail of spaced rail pairs 22, 24 and 22', 24' located adjacent opposite ends of the seats. Midway between rail pairs 22, 24 and 22', 24' the seat members 26 are further secured to a brace member 28.

FIGS. 5A, 5B and 5C show the detail of the A-shaped support sections 30 which provide the legs upon which the bench rests. More specifically, each support or leg section 30 is formed of two upright (when assembled) members 32 joined together at an apex 33 and reinforced by two parallel horizontal braces 34 with one brace 34 secured to each side of a pair of joined members 32. Each member 32 is slanted at an angle of about 30° from vertical.

FIGS. 7A and 7B depict the locking members or studs 60. Each locking member 60 has a beveled top 61 and carries block members 64 and 66 at its opposite end. The block members 64 and 66 are spaced apart to snugly receive a horizontal brace 34 of an A-shaped section 30 with a rail 22 resting thereon.

With reference to FIGS. 6A, 6B and 6C it can be seen that the top piece or cap member 40 is formed of four back support members (2×4's) 42, two on each side of wooden blocks 44, 46, 48 and 44', 46' and 48'. The distance between blocks 46 and 46' is equal to the distance between rails 24, 24'. One set of blocks 44, 46, 48 is located adjacent one end of the back support members 42 and the other set of blocks 44', 46', 48' is located adjacent the opposite ends of members 42. Each block is a generally triangular piece to which back support members 42 are fixed by conventional fasteners, e.g. wood screws. The space 45 between blocks 44 and 46 and the space 45' between blocks 44' and 46' each receive the apex 33 of an A-shaped member 30 and, accordingly, each is approximately equal to the spacing between 22 and 24, i.e. 1½" plus a slight tolerance. Further, blocks 48 and 48' are spaced from 46' 46' respectively to provide brackets for receipt of locking members 60 to be described below. As seen in FIGS. 6A, 6C and 1–3 the gaps 45 and 45, defined between blocks 44, 46 and blocks 44', 46', respectively, each receive the upper end of a locking member 60 and, like the previously described spacings, measure 1½' plus a small tolerance.

To assemble, both A-shaped support sections are placed on a flat surface and held vertically at a distance approximately six feet apart. The seat section is then slid down over the spaced A-shaped support sections with one support section being received between each pair of rails supporting the seats. A rail of the seat section will come to rest on a horizontal brace of each A section. Next, a locking stud is affixed at each end of the partially assembled bench with an abutting rail and horizontal brace fit snugly between two blocks affixed to one end of the locking stud. Finally, the cap member is placed above the apexes of the A-shaped support members and locking stud ends with each apex and locking stud end being received in triangular-shaped bracket carried by the cap member.

The invention may be embodied in other specific forms without departing from the spirit or essential characteristics thereof. The above-described embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A sectional bench for seating which may be readily broken down into a plurality of sections for transport and which may be readily assembled without fasteners into a structure capable of supporting the weight of one or more persons, said bench comprising:

a pair of A-shaped support sections, each of said A-shaped support sections comprising a pair of upright leg members with adjacent first ends joined together to form the apex of the Ashape and at least a first horizontal brace spanning and fixed to both leg members;

a seat section comprising two spaced pairs of rail members joined together at each end by elongated seat members forming bench seats, the spacing between each pair of spaced rails snugly receiving an A-shaped support section and allowing the seat section, upon assembly, to slide on each of said A-shaped support sections from said apex into a assembled position wherein at least one rail member of each of said two spaced pairs rests on one of said horizontal braces; and a cap member including first and second brackets, each bracket receiving the apex of one of said A-shaped support sections, said first and second brackets being joined together in a spaced relationship by elongated back support members providing a backrest for each of said seats.

2. The sectional bench of claim 1 wherein each bracket is formed of a pair of generally triangular blocks spaced apart by the thickness of the A-shaped support sections.

3. The sectional bench of claim 1 additionally comprising a pair of locking members in the form of elongated studs, each of said locking members having brace engaging means for locking onto the horizontal brace of an A-shaped support section, and wherein said cap member additionally comprises third and fourth brackets, located adjacent said first and second brackets respectively, for receiving and holding one end of one locking member.

4. The section bench of claim 3 wherein said brace engaging means grips one horizontal brace member together with a rail member resting on said one horizontal support member.

5. The sectional bench of claim 4 wherein said first and third brackets are formed by three generally triangular plates spaced to define two gaps, one of said gaps receiving the apex of one of said A-shaped section and the other of said two gaps receiving an end of one of said locking members.

6. The sectional bench of claim 5 wherein said brace engaging means comprises a pair of protrusions on each of said locking members, said protrusions being spaced to snugly receive a horizontal brace and superimposed rail member therebetween.

7. The sectional bench of claim 6 wherein each A-shaped section has two of said horizontal brace members arranged in parallel, one on each side of said legs members, said locking members engaging the innermost horizontal brace members.

8. The sectional bench of claim 6 wherein said protrusions are block members fixed to said elongated studs.

9. The sectional bench of claim 1 wherein each of said A-shaped support sections further comprises a second horizontal brace fixed to and spanning each joined pair of upright members, said second horizontal brace being opposite and parallel to said first horizontal brace, whereby, upon assembly, the two rails of each rail pair rest on said first and second horizontal braces, respectively.

10. A support platform which may be readily broken down into a plurality of sections for transport and which may be readily assembled without fasteners into a stable load-supporting platform, said platform comprising:

a pair of upright support sections, each support section including at least one vertical leg member and at least a first horizontal brace fixed to said leg member;

a horizontal load-receiving section including two pairs of rail members joined together at each end b first elongated members defining at least one horizontal, load-receiving surface, the spacing between each pair of spaced rails snugly receiving a support section and allowing the horizontal section, upon assembly, to slide on said support sections into an assembled position wherein at least one of said pair of rail members rests on said first horizontal brace; and a cap member including first and second brackets, each bracket receiving the vertical leg member of one of said support sections, said first and second brackets being joined together by at least one elongated spanning member, said first and second brackets being spaced by a distance equal to the distance between said rail pairs.

11. The support platform of claim 9 wherein each of said support sections are A-shaped with two vertical leg members joined together at adjacent ends to form the apex of the A with said first horizontal brace fixed to both leg members at their midsections and wherein each of said brackets receives said apex of one of s id support sections.

12. The support platform of claim 10 wherein each bracket is formed of a pair of generally triangular blocks spaced apart by the thickness of the A-shaped support sections and wherein said blocks are joined together in a spaced relationship by at least two elongated spanning members.

13. The support platform of claim 10 further comprising a second horizontal brace on said vertical leg member opposite and parallel to said first horizontal brace, whereby, upon assembly, the two rails of each rail pair rest on said first and second horizontal braces, respectively.

14. The support platform of claim 9 further comprising a pair of locking members in the form of elongated studs, each of said locking members having brace engaging means for locking onto a horizontal brace of said support section, and wherein said cap member additionally comprises third and fourth brackets, located adjacent said first and second brackets respectively, for receiving and holding an end of one locking member.

15. The support platform of claim 14, wherein said brace engaging means grips one horizontal brace member together with a rail member resting on said one horizontal support member.

16. The support platform of claim 15, wherein said first and third brackets are formed by three generally triangular plates spaced to define two gaps, one of said gaps receiving the apex of one of said A-shaped sections and the other of said two gaps receiving an end of one of said locking members.

17. The support platform of claim 16, wherein said brace engaging means comprises a pair of protrusions on each of said locking members, said protrusions being spaced to snugly receive a horizontal brace and superimposed rail member therebetween.

18. The support platform of claim 17, wherein said protrusions are block members fixed to said elongated studs.

* * * * *